US005145084A

United States Patent [19]

Murayama et al.

[11] Patent Number: 5,145,084

[45] Date of Patent: Sep. 8, 1992

[54] CONTAINER CLOSURE HAVING METALLIC BODY AND PLASTIC GRIP PIECE

[75] Inventors: Kashiwa Murayama, Fujisawa; Masakazu Tatsuta, Hiratsuka; Yoshiharu Shibata, Hiratsuka; Hideki Yajima, Hiratsuka, all of Japan

[73] Assignee: Japan Crown Cork Co., Ltd., Tokyo, Japan

[21] Appl. No.: 628,013

[22] Filed: Dec. 17, 1990

[30] Foreign Application Priority Data

Dec. 27, 1989 [JP] Japan ..... 1-336316

[51] Int. Cl.[5] ..... B65D 41/32

[52] U.S. Cl. ..... 220/260; 220/270; 215/303; 215/304; 215/255

[58] Field of Search ..... 220/260, 270, 284, 285, 220/DIG. 12; 215/303, 304, 305, 249, 317, 224, 255

[56] References Cited

U.S. PATENT DOCUMENTS

| | | | |
|---|---|---|---|
| 695,507 | 3/1901 | Strang . | |
| 1,262,385 | 4/1918 | Penza . | |
| 1,549,080 | 8/1925 | Henson | 215/304 |
| 2,238,105 | 4/1941 | Fison | 215/305 |
| 2,571,227 | 10/1951 | Fong | 215/303 |
| 2,750,062 | 6/1956 | Satz | 215/305 |
| 3,095,991 | 7/1963 | Paniagua | 215/303 |
| 3,458,907 | 8/1969 | Shannon . | |
| 3,934,722 | 1/1976 | Goldberg | 215/305 X |
| 3,999,678 | 12/1976 | Ignell et al. | 220/269 |
| 4,227,619 | 10/1980 | Magnusson | 215/255 |
| 4,312,687 | 1/1982 | Sigworth, Jr. . | |
| 4,350,261 | 9/1982 | Roth | 220/270 |
| 4,424,015 | 1/1984 | Black . | |
| 4,453,644 | 6/1984 | Berglund | 215/255 |
| 4,768,667 | 9/1988 | Magnusson | 215/255 |
| 5,071,339 | 12/1991 | Murayama . | |

FOREIGN PATENT DOCUMENTS

| | | | |
|---|---|---|---|
| 1120886 | 7/1956 | France | 215/303 |
| 57-178730 | 4/1982 | Japan . | |
| 59-191533 | 1/1984 | Japan . | |
| 59-191532 | 10/1984 | Japan . | |
| 1448590 | 8/1976 | United Kingdom . | |

OTHER PUBLICATIONS

Patent Abstracts of Japan, vol. 11, No. 321, (M-633) (2768) Oct. 20, 1987.

*Primary Examiner*—Stephen Marcus
*Assistant Examiner*—Vanessa Caretto
*Attorney, Agent, or Firm*—Beveridge, DeGrandi & Weilacher

[57] ABSTRACT

A container closure is disclosed having a metallic body and a plastic grip piece. The body includes a top panel wall, a skirt wall extending down from the perepheral edge of the top panel wall, and a linking protruding piece that protrudes from the lower end of the skirt wall. The grip piece includes a linking base portion that covers at least both surfaces of the end portion of the linking protruding piece of the body, and a grip portion that extends from the linking base portion. The grip piece is formed and is, at the same time, linked to the linking protruding piece of the body by flowing a plastic material from one side of the linking protruding piece that positions in the space of the mold. A plastic material inflow groove that extends from the free end thereof toward the lower end of the skirt wall is formed on the side of the other surface of the linking protruding piece of the body.

4 Claims, 7 Drawing Sheets

Fig.15-A
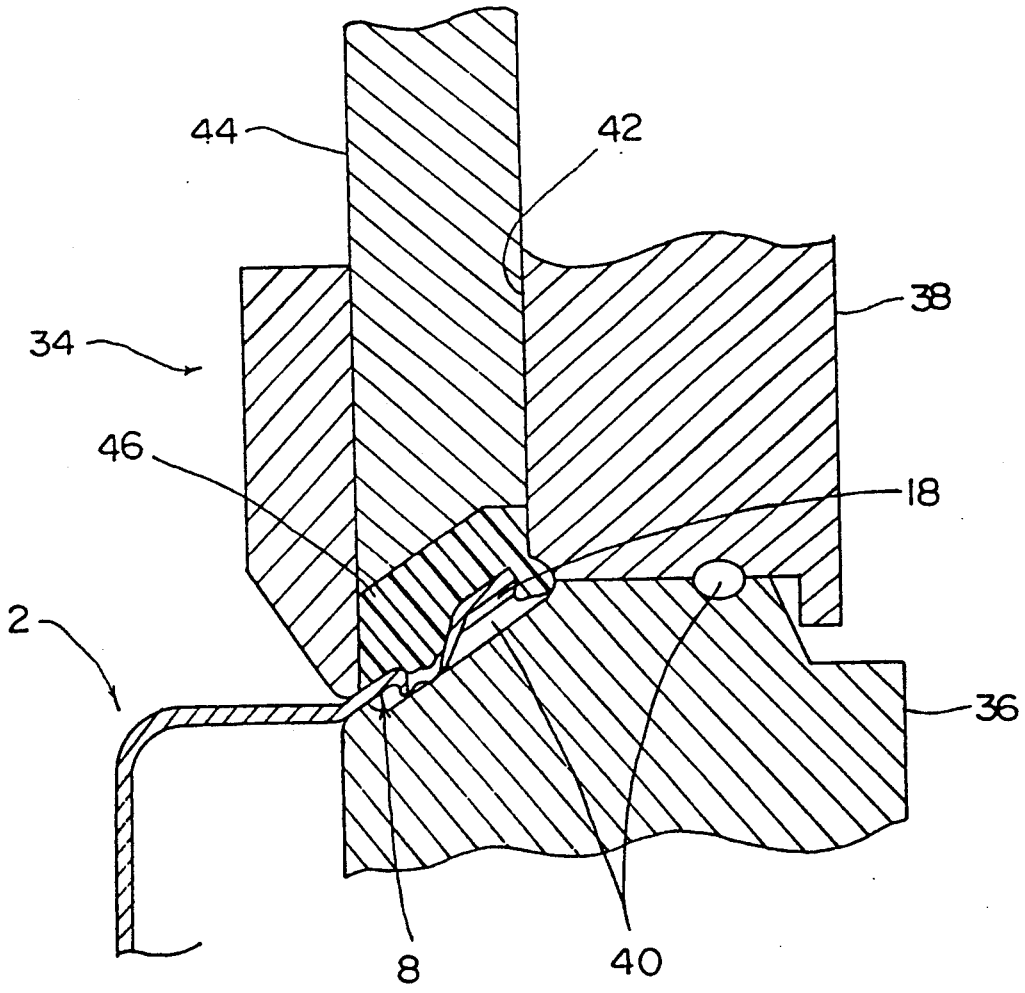

Fig.15-B
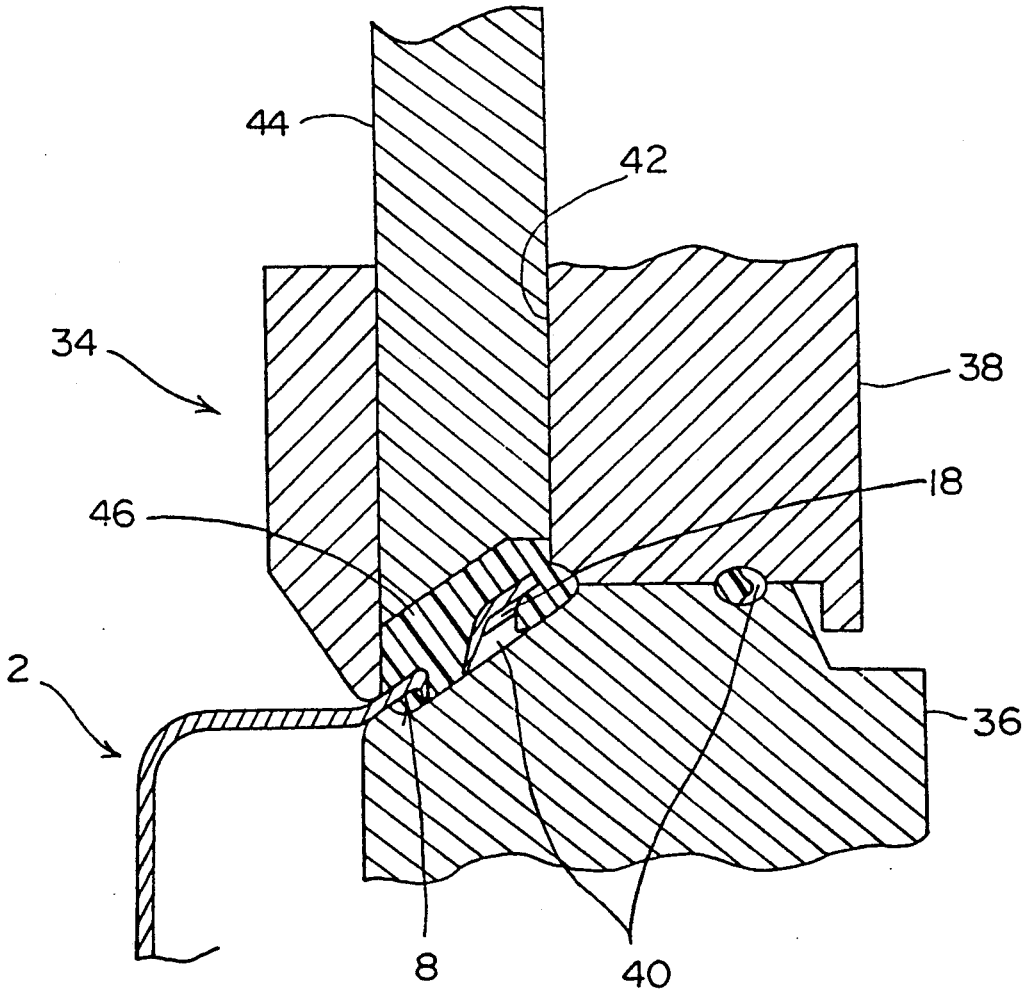

Fig.15-C
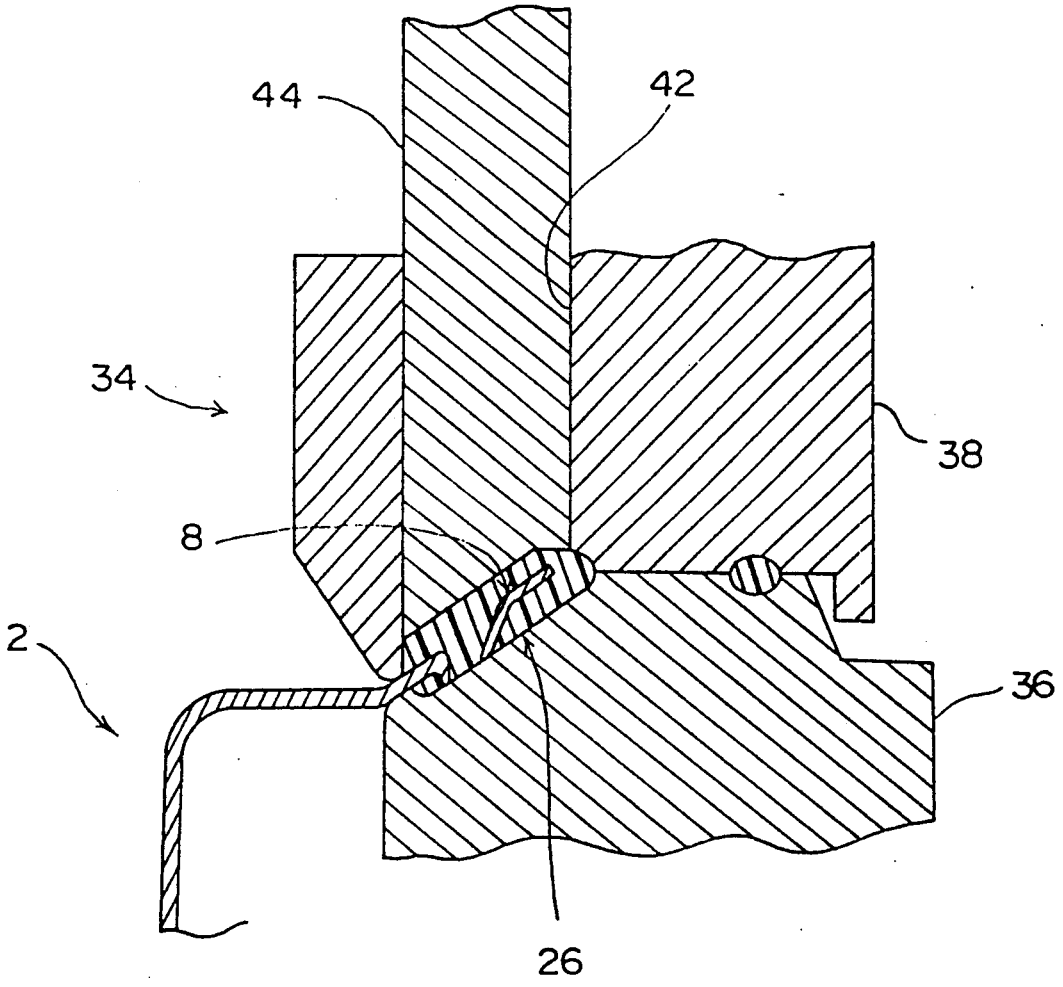

CONTAINER CLOSURE HAVING METALLIC BODY AND PLASTIC GRIP PIECE

FIELD OF THE INVENTION

The present invention relates a container closure having a metallic body with a linking protruding piece and having a plastic resin grip piece linked to the linking protruding piece.

DESCRIPTION OF THE PRIOR ART

Japanese Laid-Open Patent Publication No. 178730/1982 discloses a container closure comprised of a metallic body and a plastic grip piece as a suitable example of a simple openable container closure. The metallic body is formed from a suitable thin metallic plate such as a thin plate of an aluminum-base alloy, and has a top panel wall, a skirt wall extending down from the peripheral edge of the top panel wall, and a linking protruding piece protruding from the lower end of the skirt wall. The plastic grip piece made of a suitable plastic resin material such as polyethylene or polypropylene includes a linking base portion that covers at least both surfaces of an end portion of the linking grip piece of the container closure body and a grip portion that extends from the linking base portion. The grip portion should preferably have the shape of a ring.

Japanese Patent Laid-Open Publication No. 302010/1988 discloses a compression molding apparatus for forming a plastic grip piece for the above container closure and simultaneously linking it to a linking protruding piece of the container closure body. In such a compression molding apparatus, the linking protruding piece of the container closure body is located in the space of a mold, and the plastic material is allowed to flow in from the side of one surface of the linking protruding piece. The linking protruding piece has at least one hole, and the plastic material for forming the grip piece is allowed to flow in through this hole, too.

The experience of the present inventors tells that the conventional container closure as mentioned above has the following problems still to be solved. The plastic material flowing in from the side of one surface of the linking protruding piece positioned in the mold does not enter to the side of the other surface of the linking protruding piece as expected, and consequently, the plastic material covering the side of the other surface of the linking protruding piece becomes markedly thin, or the side of the other surface of the linking protruding piece is not fully covered with the plastic material but is locally exposed. Should that happen, the linking strength of the grip piece decreases relative to the body, the container closure deteriorates in appearance to a considerable degree, and defective container closures that are not commercially acceptable as products are produced.

SUMMARY OF THE INVENTION

It is a main object of the present invention to solve the above problem in the prior art and to improve the shape of the linking protruding piece of the metallic body such that the plastic material that flows from the side of one surface of the linking protruding piece enters sufficiently well to the side of the other surface.

In order to achieve the above object according to the present invention, there is formed on the side of the other surface of the linking protruding piece of the metallic body a plastic material inflow groove that extends from the free end thereof to the lower end of the skirt wall.

According to the present invention, there is provided a container closure which comprises a metallic body having a top panel wall, a skirt wall extending down from the peripheral edge of the top panel wall, and a linking protruding piece protruding from the lower end of said skirt wall; and a plastic grip piece having a linking base portion for covering at least both surfaces of the end portion of the linking protruding piece of said body, and a grip portion extending from said linking base portion, said plastic grip piece being formed by feeding a plastic material from the side of one surface of the linking protruding piece that is positioned in space of the mold, and being linked, at the same time, to the linking protruding piece of said body; wherein a plastic material inflow groove that extends from the free end thereof toward the lower end of said skirt wall is formed on the side of the other surface of the linking protruding piece of said body.

Preferably, the linking protruding piece of the metallic body has at least one hole through which the plastic material to form the grip piece is allowed to flow in. In this case, the plastic material inflow groove should desirably extend from the free end of the linking protruding piece up to said groove. Desirably, a protuberance is formed on the surface of the linking base portion of the plastic grip piece at a portion covering the side of one surface of the linking protruding piece of the body, the protuberance extending along the plastic material inflow groove.

In forming the plastic grip piece of the container closure according to the present invention, the plastic material flows in from the side of one surface of the linking protruding piece of the metallic body, enters into the plastic material inflow groove from the free end of the linking protruding piece, and favorably flows to the side of the other surface of the linking protruding piece. Thus, the above-mentioned problem inherent in the conventional container closures is reliably solved.

BRIEF DESCRIPTION OF THE DRAWINGS

FIGS. 15-A, 15-B and 15-C are schematic views showing the steps for compression-molding the plastic grip piece shown in FIGS. 13 and 14.

DETAILED DESCRIPTION OF THE PREFERRED EMBODIMENTS

Preferred embodiments of the container closure constituted according to the present invention will now be described in detail with reference to the accompanying drawings.

Figure 1:
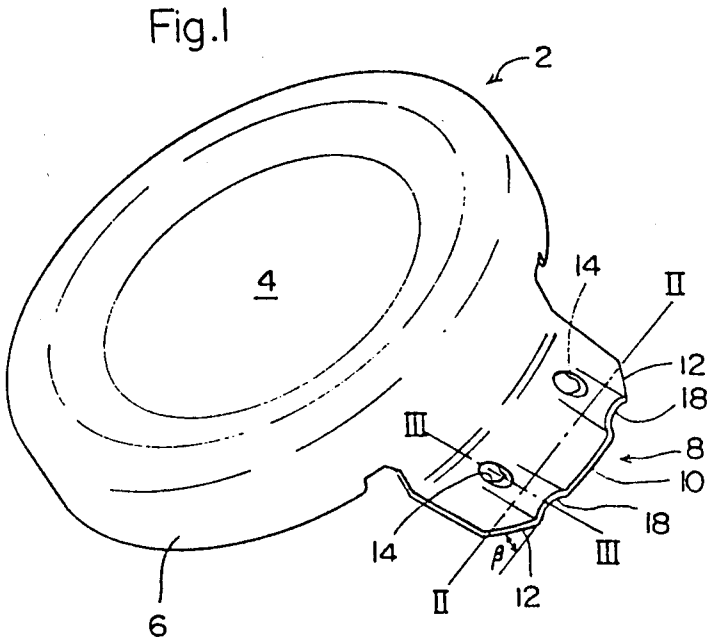
FIG. 1 is a perspective view showing an embodiment of a metallic body in a container closure improved according to the present invention.

FIG. 1 shows a metallic body in a preferred embodiment of a container closure constituted according to the present invention. The body 2 that can be made of a suitable thin metallic plate such as a thin plate of an aluminum-base alloy, a thin plate of a steel treated with chromic acid, or a thin tin plate, includes a circular top panel wall 4, a cylindrical skirt wall 6 extending down from the peripheral edge of the top panel wall 4, and a linking protruding piece 8 protruding from the lower end of the skirt wall 6. The linking protruding piece 8 may protrude from the lower end of the skirt wall 6 substantially in parallel with a center axis corresponding to the center axis of the cylindrical skirt wall 6 or substantially perpendicularly to the center axis. In the diagrammed embodiment, however, the linking protruding piece 8 protrudes from the lower end of the skirt wall 6 radially outwardly in a downwardly inclined direction with an inclination angle $\alpha$ (FIG. 3) of about 15 to 60 degrees with respect to the center axis. A central portion 10 at the free end of the linking protruding piece 8 extends substantially in parallel with the lower end of the skirt wall 6. Both ends 12 at the free end should preferably have an inclination angle $\beta$ of about 20 to 50 degrees to extend toward both edges being inclined in the direction of skirt wall 6. Two holes 14 are formed in nearly a middle portion of the linking protruding piece 8 in a direction in which it protrudes, the two holes 14 maintaining a suitable distance from each other in the direction of width (in the circumferential direction of the skirt wall 6). Preferably, the holes 14 should be downwardly burred as designated at 16 (FIG. 3) at their peripheral edges (as for forming the holes 14 having burr 16 and their functions and effects, reference should be made to the specification and drawings of Japanese Patent Laid-Open Publication No. 15237/1989 and Japanese Patent Application No. 121361/1989 filed by the present applicant).

Figure 2:
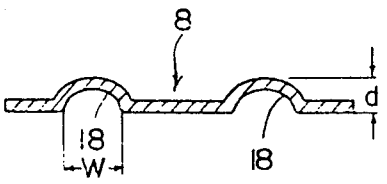
FIGS. 2 and 3 are, respectively, sectional views along the line II—II and the line III—III of FIG. 1.
Figure 3:
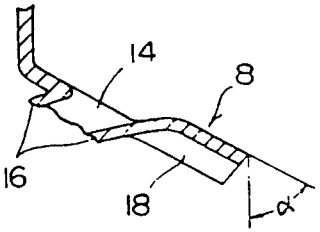
Figure 1B:
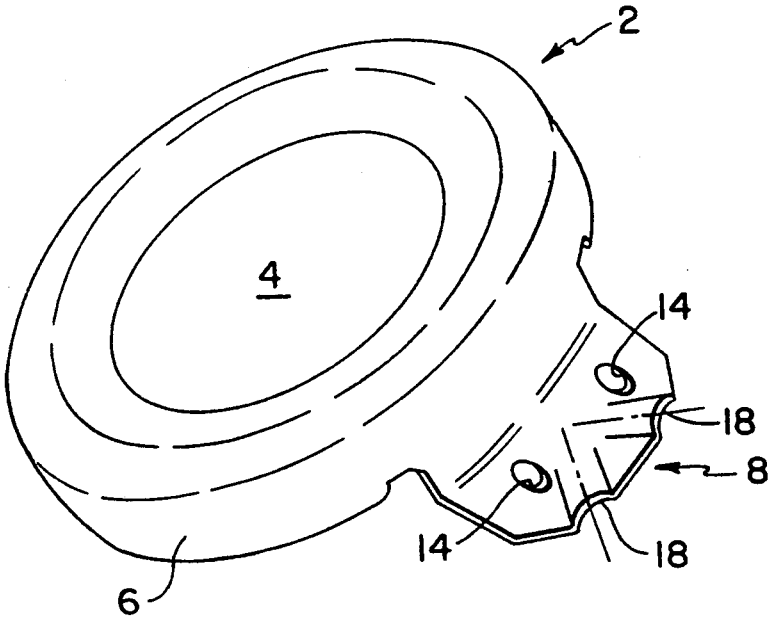
FIG. 1B is a perspective view showing an embodiment of a metallic body in a container closure in accordance with the invention.

With reference to FIGS. 2 and 3 in conjunction with FIG. 1, what is important in the body 2 of the container enclosure constituted according to the present invention is that at least one plastic material inflow groove that extends from the free ends 10 and 12 toward the lower end of the skirt wall 6 is formed on the side of the lower surface of the linking protruding piece 8. In the diagrammed embodiment, two plastic material inflow grooves 18 are formed extending from both side portions of the central portion 10 of the free end up to the holes 14, the two plastic material inflow grooves 18 being substantially parallel to one another, as shown in FIG. 1. The plastic material inflow grooves 18 are formed by locally curving the linking protruding piece 8 so as to form a wave like cross section, as shown in FIG. 2. As will be clearly understood from FIGS. 2 and 3, the plastic material inflow grooves 18 have a width w and a depth d that retain nearly the same sizes from the free end 10 up to the holes 14. Though it may vary depending on the size of the metallic body 2 and the linking protruding piece 8, the synthetic resin inflow grooves 18 should have the width w over a range of 1 mm$\leqq$w$\leqq$3 mm and the depth d over a range of 0.5 mm$\leqq$d$\leqq$3 mm. As required, the plastic material inflow grooves may be formed extending from both end portions 12 of the free end toward the lower end of the skirt wall 6. In this case, it is desired that the plastic material inflow grooves extend gradually inclined inwardly in the direction of width as they approach from the both end portions of the free ends toward the lower end of the skirt wall 6. It is also allowable to form the plastic material inflow groove 18 such that it extends, for example, toward the intermediate region between the two holes 14, as shown in FIG. 1B instead of forming the plastic material inflow grooves 18 that are headed towards the holes 14.

Figure 4:
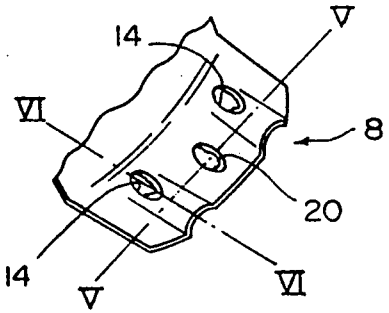
FIG. 4 is a partial perspective view showing a modified embodiment of the metallic body in the container closure improved according to the present invention.
Figure 5:
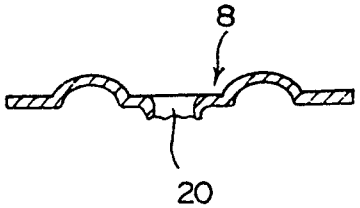
FIGS. 5 and 6 are, respectively, sectional views along the line V—V and the line VI—VI of FIG. 4.
Figure 6:
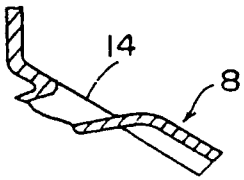

FIGS. 4 to 6 show a first modified embodiment of the metallic body. According to the first modified embodiment, a hole 20 is formed in the linking protruding piece 8 at a position between the two holes 14 in addition to these two holes 14. The hole 20 is positioned slightly closer to the free end than the above two holes 14 in a direction in which the linking protruding piece 8 protrudes.

Figure 9:
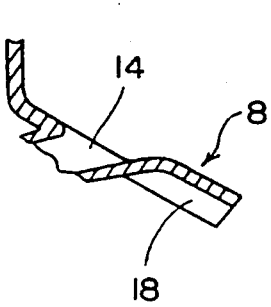
FIGS. 8 and 9 are, respectively, sectional views along the line VIII—VIII and the line IX—IX of FIG. 7.
Figure 8:
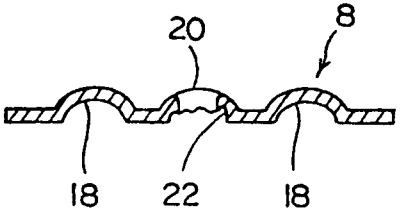
Figure 7:
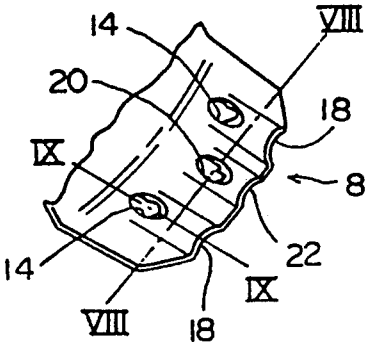
FIG. 7 is a partial perspective view showing another modified embodiment of the metallic body in the container closure improved according to the present invention.

FIGS. 7 to 9 show a second modified embodiment of the metallic body. According to the second modified embodiment, a hole 20 is formed in addition to the two holes 14, and further a plastic material inflow groove 22 is formed to extend from the center of the free end 10 up to the hole 20 in addition to the two plastic material inflow grooves 18 that extend from the free end 10 of the linking protruding piece 8 up to the holes 14.

Figure 12:
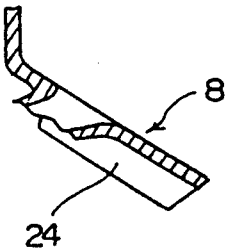
FIGS. 11 and 12 are, respectively, sectional views along the line XI—XI and the line XII—XII of FIG. 10.
Figure 11:
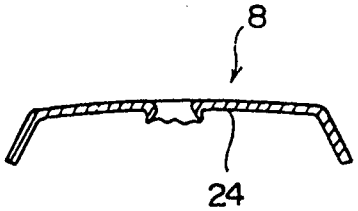
Figure 10:
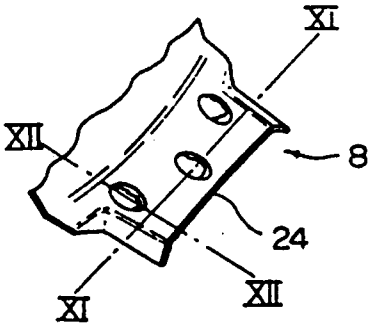
FIG. 10 is a partial perspective view showing a further another modified embodiment of the metallic body in the container closure improved according to the present invention.

FIGS. 10 to 12 show a third modified embodiment of the metallic body. According to the third modified embodiment, both sides of the linking protruding piece 8 is downwardly folded to form a plastic material inflow groove 24 having a considerably great width instead of forming three plastic material inflow grooves 18 and 22.

Figure 14:
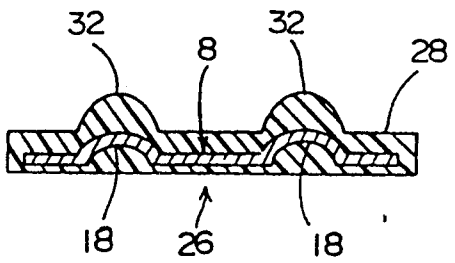
FIG. 14 is a sectional view along the line XIV—XIV of FIG. 13.
Figure 13:
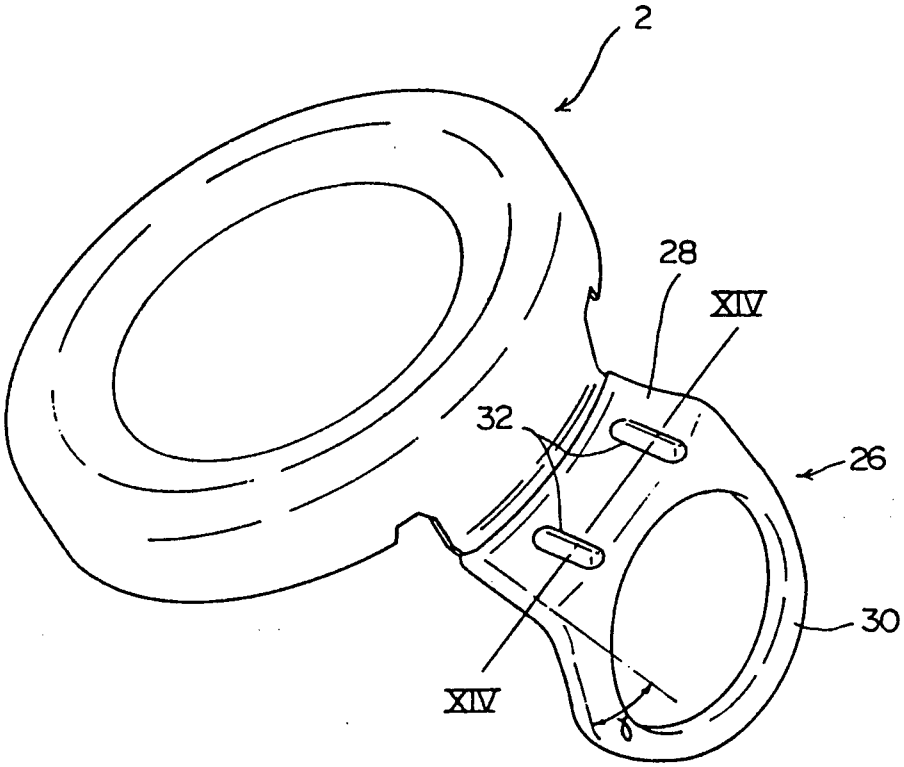
FIGS. 13 is a perspective view showing a container closure comprised of the metallic body of FIG. 1 and the plastic grip piece formed integrally and being linked together.

FIGS. 13 and 14 show a container closure comprised of the metallic body 2 diagrammed in FIGS. 1 to 3 and a plastic grip piece 26 that is linked to the linking protruding piece 8 as a unitary structure. The plastic grip piece 26 includes a linking base portion 28 that covers nearly the whole linking protruding piece 8 of the body 2 excluding some base end portion thereof, and a grip portion 30 that extends from the linking base portion 28. As clearly shown in FIG. 14, it is important that the linking base portion 28 covers the upper surface side (one surface side) as well as the lower surface side (other surface side) of the linking protruding piece 8 of the body 2. The grip portion 30 in the diagrammed embodiment has the shape of a ring and extends downwardly at an angle $\gamma$ of 20 to 50 degrees with respect to the linking base portion 28. A pair of protuberances 32 are formed on the upper surface (surface of a portion covering the upper surface side of the linking protruding piece 8) of the linking base portion 28. The protuberances 32 extend along the plastic material inflow grooves 18 formed in the linking protruding piece 8 of the body 2. The protuberances 32 have a width and a height that nearly correspond to the width and depth of the plastic material inflow grooves 18.

FIGS. 15-A to 15-C schematically illustrate the steps for compression-molding the grip piece 26 from a suitable plastic material such as polyethylene or polypropylene. In compression-molding the grip piece 26, the linking protruding piece 8 of the metallic body 2 is positioned in space of the mold as shown in FIG. 15-A. The mold for compression molding, generally designated at 34, includes a lower mold portion 36 and an upper mold portion 38, and space 40 for molding the grip piece is defined therebetween. In the upper mold portion 38 is formed a conduit hole 42 that upwardly extends from the space 40, and a compression rod 44 is slidably fitted into the conduit hole 42. The plastic resin material 46 under the softened and molten condition is fed into the conduit hole 42, gradually compressed as the compression rod 44 descends, and flows into the space 40 of the mold. The conduit hole 42 upwardly extends from the space 40 of the mold, and the plastic resin material 46 flows into the space 40 of the mold from the upper surface side of the linking protruding piece 8 of the metallic body 2. Therefore, the plastic resin material 46 that flows from the upper surface side exerts a pressing force on the linking protruding piece 8 of the metallic body 2 to urge it downwardly. In the container closure improved according to the present invention, since the plastic material inflow grooves 18 are formed on the lower surface side of the linking protruding piece 8 of the metallic body 2, the plastic resin material flows from the upper surface side of the linking protruding piece 8 into the plastic material inflow grooves 18 via free ends 10 and 12 of the linking protruding piece 8, so that the plastic resin material can flow very favorably into the lower surface side of the linking protruding piece 8 even in case the linking protruding piece 8 is pressed onto the lower surface of the space 40 of the mold, as will be easily understood with reference to FIGS. 15-A to 15-C. Therefore, it is made possible to compression-mold a sufficiently favorable grip piece 26 as desired and to sufficiently well link it to the linking protruding piece 8 of the body 2 without developing such defects that the linking base portion 28 of the grip piece 26 becomes very thin on the lower surface side of the linking protruding piece 8 or the lower surface of the linking protruding piece 8 is not locally covered with the plastic material. The compression molding apparatus 34 itself may be substantially the same as the one disclosed in the aforementioned Japanese Patent Laid-Open Publication No. 302010/1988. Therefore, constitution of the compression molding apparatus 34 is not described in detail in this specification.

The present invention has been described in detail with regard to suitable embodiments of the container closure constituted according to the present invention with reference to the accompanying drawings, but it should be understood that the invention is not limited to such embodiments only, and various changes and modifications are possible without departing from the scope of the present invention described and claimed herein.

What we claim is:

1. A container closure comprising:

a metallic body having a top panel wall, a skirt wall extending down from a peripheral edge of the top panel wall, and a linking protruding piece protruding from a lower end of said skirt wall; and a plastic grip piece having a linking base portion for covering at least both surfaces of an end portion of the linking protruding piece of said body, and a grip portion extending from said linking base portion, said plastic grip piece being formed by feeding a plastic material from a side of one surface of the linking protruding piece that is positioned in a mold, said plastic grip piece being linked to the linking protruding piece of said body; wherein a plastic material inflow groove extends from a free end of the linking protruding piece toward a lower end of said skirt wall formed on a side of another surface of the linking protruding piece of said body, wherein said plastic material inflow groove is provided to allow the plastic material to flow from said one surface to said another surface during molding of the grip piece.

2. A container closure according to claim 1 wherein said linking protruding piece of said body defines at least one hole for flowing the plastic material to form said grip piece.

3. A container closure according to claim 2, wherein said plastic material inflow groove formed on the side of said another surface of the linking protruding piece extends from the free end of the linking protruding piece of said body up to said hole.

4. A container closure according to claim 1, wherein protuberances are formed on a surface of said linking base portion of said grip piece at a portion that covers the side of said one surface of the linking protruding piece of said body, said protuberances extending along said plastic material inflow grooves that are formed on the side of said another surface of the linking protruding piece of said body.

* * * * *